US010492572B1

(12) United States Patent
Omote et al.

(10) Patent No.: US 10,492,572 B1
(45) Date of Patent: Dec. 3, 2019

(54) SLIDE COVERS FOR HEAD TO HEAD SLIDERS AND METHODS OF ASSEMBLY AND USE THEREOF

(71) Applicant: YKK Corporation of America, Marietta, GA (US)

(72) Inventors: Sayuri Omote, Toyoma (JP); Suguru Ogura, Taipei (TW); Mingsi Wang, Macon, GA (US)

(73) Assignee: YKK Corporation of America, Marietta, GA (US)

( * ) Notice: Subject to any disclaimer, the term of this patent is extended or adjusted under 35 U.S.C. 154(b) by 0 days.

(21) Appl. No.: 16/119,069

(22) Filed: Aug. 31, 2018

(51) Int. Cl.
*A44B 19/26* (2006.01)
*A44B 19/32* (2006.01)

(52) U.S. Cl.
CPC ..... *A44B 19/26* (2013.01); *A44B 19/32* (2013.01)

(58) Field of Classification Search
CPC ..... A44B 19/26; A44B 19/32; A44B 19/301; A44B 19/303; Y10T 24/2509; Y10T 24/2588; Y10T 70/5053
See application file for complete search history.

(56) References Cited

U.S. PATENT DOCUMENTS 4,395,891 A * 8/1983 Remington ..... A44B 19/301 70/68
4,976,120 A * 12/1990 Terada ..... A44B 19/301 70/312
6,062,051 A * 5/2000 Nam ..... A44B 19/301 70/68
6,510,593 B1 * 1/2003 Kim ..... A44B 19/301 24/382
7,073,233 B2 * 7/2006 Leva ..... A44B 19/26 24/386
D526,931 S 8/2006 Koenig et al.
(Continued)

FOREIGN PATENT DOCUMENTS

CN 201976897 U 9/2011
CN 204169190 U 2/2015
(Continued)

OTHER PUBLICATIONS

Slider with plastic water blocker, https//www.ykkfastening.com/products/search/detail, Accessed Nov. 27, 2018.

*Primary Examiner* — Victor D Batson
*Assistant Examiner* — Rowland Do
(74) *Attorney, Agent, or Firm* — Meunier Carlin & Curfman LLC

(57) ABSTRACT

Various implementations include a slide fastener with head to head sliders that prevents the sliders from moving apart from each other unintentionally and prevents liquid from flowing through the slide fastener. The slide fastener includes first and second sliders that are slidably coupled to a pair of interlocking stringers. The slide fastener also includes slider covers that are each coupled to a respective slider. The slider covers engage each other when the sliders are pulled together. In some implementations, the engagement of the slider covers prevents unintentional separation and/or prevents liquid from flowing out of or into a cavity defined by an inner side of the slider covers that extends around facing front faces of the sliders on one side of the interlocking stringers.

21 Claims, 16 Drawing Sheets

(56) References Cited

U.S. PATENT DOCUMENTS

| | | | | |
|---|---|---|---|---|
| 7,506,417 | B2 * | 3/2009 | Yoneoka | A44B 19/301 24/386 |
| 7,533,451 | B2 * | 5/2009 | Akashi | A44B 19/301 24/386 |
| 9,902,529 | B2 * | 2/2018 | Reinders | B65D 33/2591 |
| 2005/0109072 | A1 * | 5/2005 | Ling | A44B 19/301 70/68 |

FOREIGN PATENT DOCUMENTS

| | | | |
|---|---|---|---|
| EP | 1300094 | A1 | 4/2003 |
| WO | 2011004500 | A1 | 1/2011 |

* cited by examiner

SLIDE COVERS FOR HEAD TO HEAD SLIDERS AND METHODS OF ASSEMBLY AND USE THEREOF

BACKGROUND

Typical head to head sliders are not able to prevent liquid from passing between the sliders when they are urged together. For example, head to head sliders may be used on coolers to attach a lid to a body of the cooler, on backpacks and tents to access openings, and on clothing (e.g., outerwear). In addition, head to head sliders may move away from each other due to vibration of the object to which the sliders are attached, gravity, or other forces acting on the sliders.

Thus, there is a need in the art to provide a slide fastener with head to head sliders that prevents the flow of a liquid (e.g., water) through the slide fastener. There is also a need in the art to provide a slide fastener with head to head sliders that prevents the head to head sliders from moving apart unintentionally.

BRIEF SUMMARY

Various implementations include a slide fastener that comprises a first slider and a second slider, a plug slider cover, and a socket slider cover. The first slider and the second slider are slidably coupled to a pair of interlocking stringers. Each slider has an interior wing, an exterior wing, a connecting portion extending between at least a portion of facing and spaced apart surfaces of the interior wing and the exterior wing, and a crown that extends from an outer surface of the exterior wing. Each of the interior wing and the exterior wing comprise a front face. The plug slider cover comprises a main body that has an inner side and an outer side and an engagement face that extends between the inner side and the outer side. The plug slider cover also includes one or more plugs that extend from the engagement face of the plug slider cover and one or more protrusions that extend from the inner side of the main body toward a plane that includes surfaces of the interlocking stringers that face the protrusions. The inner side of the plug slider cover abuts the outer surface of the exterior wing of the first slider. The socket slider cover comprises a main body that has an inner side and an outer side and an engagement face that extends between the inner side and the outer side of the main body of the socket slider cover. The socket slider cover also includes one or more protrusions that extend from the inner side of the main body of the socket slider cover toward the plane that includes surfaces of the interlocking stringers that face the protrusions. The engagement face of the main body of the socket slider cover defines at least one socket. And, the inner side of the socket slider cover abuts the outer surface of the exterior wing of the second slider. The one or more plugs of the plug slider cover engage the at least one socket of the socket slider cover when the first and second slider are urged toward each other, and the one or more plugs of the plug slider cover disengage the at least one socket of the socket slider cover when the first and second slider are urged away from each other.

In some implementations, the inner and outer sides of the plug slider cover define an opening that extends through the main body of the plug slider cover, and the crown of the first slider extends through the opening and compresses a portion of the plug slider cover disposed between the crown and the outer surface of the exterior wing of the first slider. The inner and outer sides of the main body of the socket slider cover define an opening that extends through the main body of the socket slider cover, and the crown of the second slider extends through the opening that extends through the main body of the socket slider cover and compresses a portion of the socket slider cover disposed between the crown and the outer surface of the exterior wing of the second slider.

In some implementations, the distal ends of the one or more protrusions of the plug slider cover and the socket slider cover contact the adjacent surfaces of the interlocking stringers.

In some implementations, engagement faces of the plug slider cover and the socket slider cover are sealed together when the one or more plugs are engaged with the at least one socket. For example, in some implementations, the engagement face of the plug slider cover comprises a lip that extends from and along at least a portion of the engagement face. The lip is spaced apart from the outer side and the inner side of the main body of the plug slider cover. The engagement face of the socket slider cover defines a channel that is in communication with the at least one socket. The channel receives the lip of the engagement face of the plug slider cover when the one or more plugs are engaged with the at least one socket. And, in some implementations, inner sides of the covers and the portions of the stringers that are between the front faces of the sliders define a cavity when the engagement faces of the plug slider covers and the socket slider cover abut each other. The inner sides of the covers prevent liquid from flowing between the cavity and outer sides of the covers.

In some implementations, the one or more plugs comprises a first lateral arm and a second lateral arm. Each arm comprises a neck portion and a head portion. The neck portion extends between the head portion and the engagement face, the head portion is spaced apart from the engagement face, the arms are biased in lateral directions, and the neck portion has a width that is less than a width of the head portion.

In some implementations, the one or more protrusions of the plug slider cover comprise a first lateral protrusion and a second lateral protrusion. The first and second lateral protrusions each comprise a contact face, and the contact faces of the first and second lateral protrusions abut at least a portion of the front face of the exterior wing of the first slider. For example, in some implementations, the contact face is arcuate shaped. In other implementations, the contact face is planar. In some implementations, a contour of the contact face corresponds to a contour of the respective portion of the front face that the contact face abuts. And, in some implementations, each slider comprises a first lateral exterior retaining flange that extends from the facing surface of the exterior wing adjacent a first lateral side of the exterior wing, a second lateral exterior retaining flange that extends from the facing surface of the exterior wing adjacent a second lateral side of the exterior wing, a first lateral interior retaining flange that extends from the facing surface of the interior wing adjacent a first lateral side of the interior wing, and a second lateral interior retaining flange that extends from the facing surface of the interior wing adjacent a second lateral side of the interior wing. Each retaining flange has a distal end, and the distal ends of the first lateral exterior retaining flange and the first lateral interior retaining flange are aligned between the facing surfaces and are spaced apart from each other. The distal ends of the second lateral exterior retaining flange and the second lateral interior retaining flange are aligned between the facing surfaces and are spaced apart from each other, and the distal ends of the first and second lateral exterior retaining flanges and distal ends of the first and second lateral protrusions are coplanar. In some implementations, the contact faces of the first and second lateral protrusions are biased medially toward the portions of the front faces of the exterior wing of the first slider that the first and second lateral protrusions abut. For example, in some implementations, at least a portion of each contact face lies within a plane that extends at an angle that is greater than 0° and less than 90° relative to a plane that is orthogonal to the inner side of the main body and extends through the respective protrusion.

In some implementations, the main body of the plug slider cover and/or the socket slider cover comprises a rear portion that is opposite and spaced apart from the engagement face of the respective cover, and the rear portion is compressed between the outer surface of the exterior wing of the respective slider and the crown of the respective. For example, in some implementations, the rear portion of the main body of the respective cover is compressed between the outer surface of the exterior wing of the respective slider and the crown of the respective slider after a distal end of the crown of the respective slider is pushed toward the outer surface of the exterior wing of the respective slider. In a further implementation, the opening defined by the inner and outer sides of the main body of the respective cover is further defined by the rear portion of the respective cover.

In some implementations, the plug slider cover and the socket slider cover comprise a polymer material.

In some implementations, the engagement face of the plug slider cover is arcuate shaped. And, in some implementations, the engagement face of the plug slider cover has one or more planar shaped portions.

In various other implementations, a slide fastener comprises a first slider and a second slider for slidably coupling on a pair of interlocking stringers, a plug slider cover, and a socket slider cover. Each slider has an interior wing, an exterior wing, a connecting portion extending between at least a portion of facing and spaced apart surfaces of the interior wing and the exterior wing, and a crown that extends from an outer surface of the exterior wing. Each of the interior wing and the exterior wing comprise a front face. The plug slider cover comprises a main body that has an inner side and an outer side, an engagement face that extends between the inner side and the outer side, and one or more plugs that extend from the engagement face of the plug slider cover. The crown of the first slider extends through the opening and compresses a portion of the plug slider cover disposed between the crown and the outer surface of the exterior wing of the first slider. The socket slider cover comprises a main body that has an inner side and an outer side and an engagement face that extends between the inner side and the outer side of the main body of the socket slider cover. The engagement face of the main body of the socket slider cover defines at least one socket, and the crown of the second slider extends through the opening that extends through the main body of the socket slider cover and compresses a portion of the socket slider cover disposed between the crown and the outer surface of the exterior wing of the second slider. The one or more plugs of the plug slider cover engage the at least one socket of the socket slider cover when the first and second slider are urged toward each other, and the one or more plugs of the plug slider cover disengage the at least one socket of the socket slider cover when the first and second slider are urged away from each other.

BRIEF DESCRIPTION OF THE DRAWINGS

Example features and implementation are disclosed in the accompanying drawings. However, the present disclosure is not limited to the arrangements and instrumentalities shown. Furthermore, various features may not be drawn to scale.

DETAILED DESCRIPTION

Various implementations include a slide fastener with head to head sliders that prevents the sliders from moving apart from each other unintentionally and prevents liquid from flowing through the slide fastener. The slide fastener includes first and second sliders that are slidably coupled to a pair of interlocking stringers. The slide fastener also includes slider covers that are each coupled to a respective slider. The slider covers engage each other when the sliders are pulled together. In some implementations, the engagement of the slider covers prevents unintentional separation and/or liquid from flowing out of or into a cavity defined by an inner side of the slider covers that extends around facing front faces of the sliders on one side of the interlocking stringers. It should be understood from this disclosure that the features of securing the sliders adjacent each other and preventing the flow of liquids through the slide fastener can be provided together or separately, according to various implementations.

FIGS. 1-8E and 9A-11 illustrate a slide fastener 10 according to one implementation that prevents unintentional separation of a first slider 20 and prevents the flow of liquid through the slide fastener 10.

Slide Fastener

Figure 1:
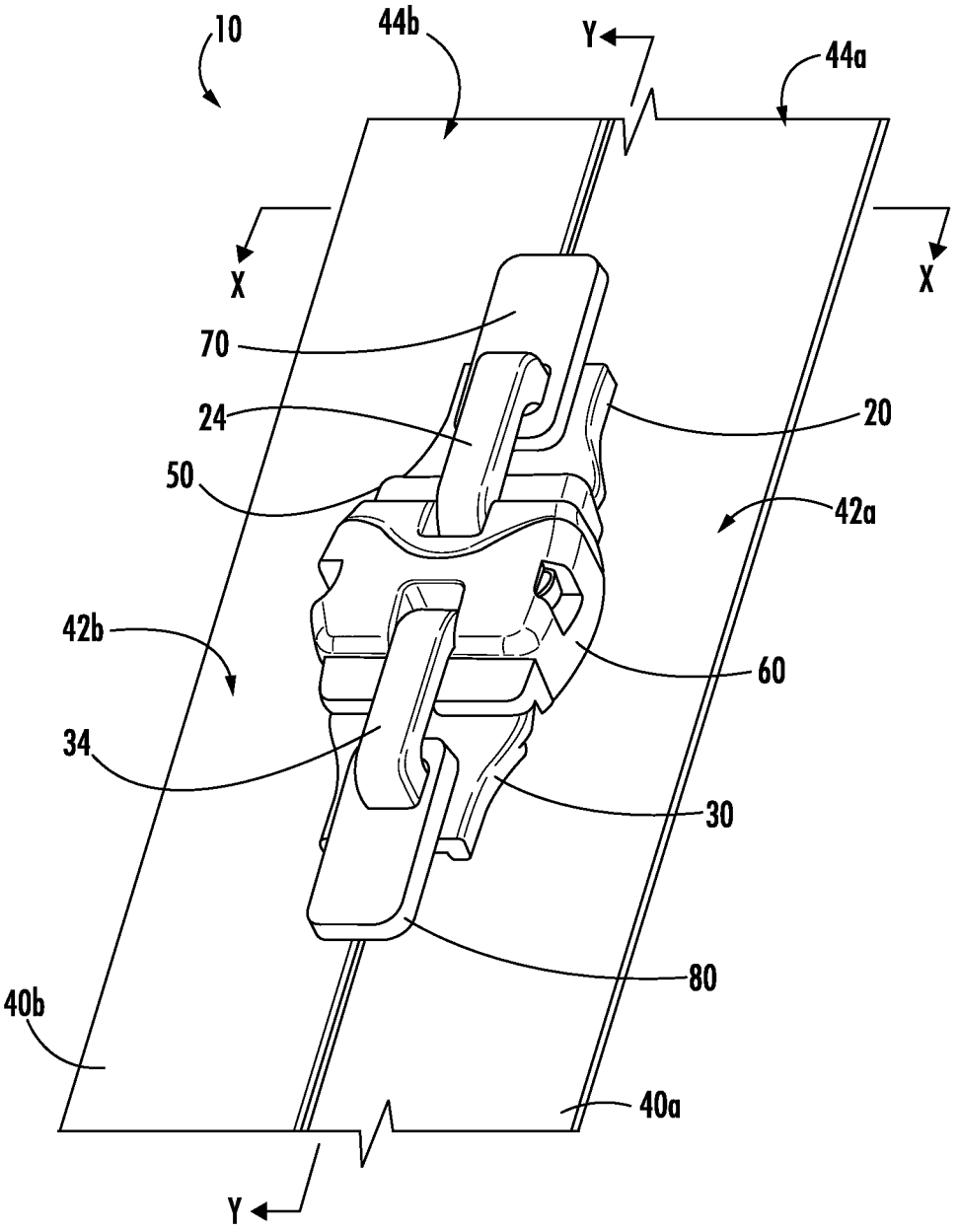
FIG. 1 illustrates an exterior perspective view of a portion of a slide fastener according to one implementation.

As shown in FIG. 1, the slide fastener 10 includes a first interlocking stringer 40*a*, a second interlocking stringer 40*b*, the first slider 20, a second slider 30, a plug slider cover 50, a socket slider cover 60, a first pull tab 70, and a second pull tab 80. The first slider 20 and the second slider 30 are coupled to the first 40*a* and second interlocking stringers 40*b*, the plug slider cover 50 and the first pull tab 70 are coupled to the first slider 20, and the socket slider cover 60 and the second pull tab 80 are coupled to the second slider 30.

Figure 7:
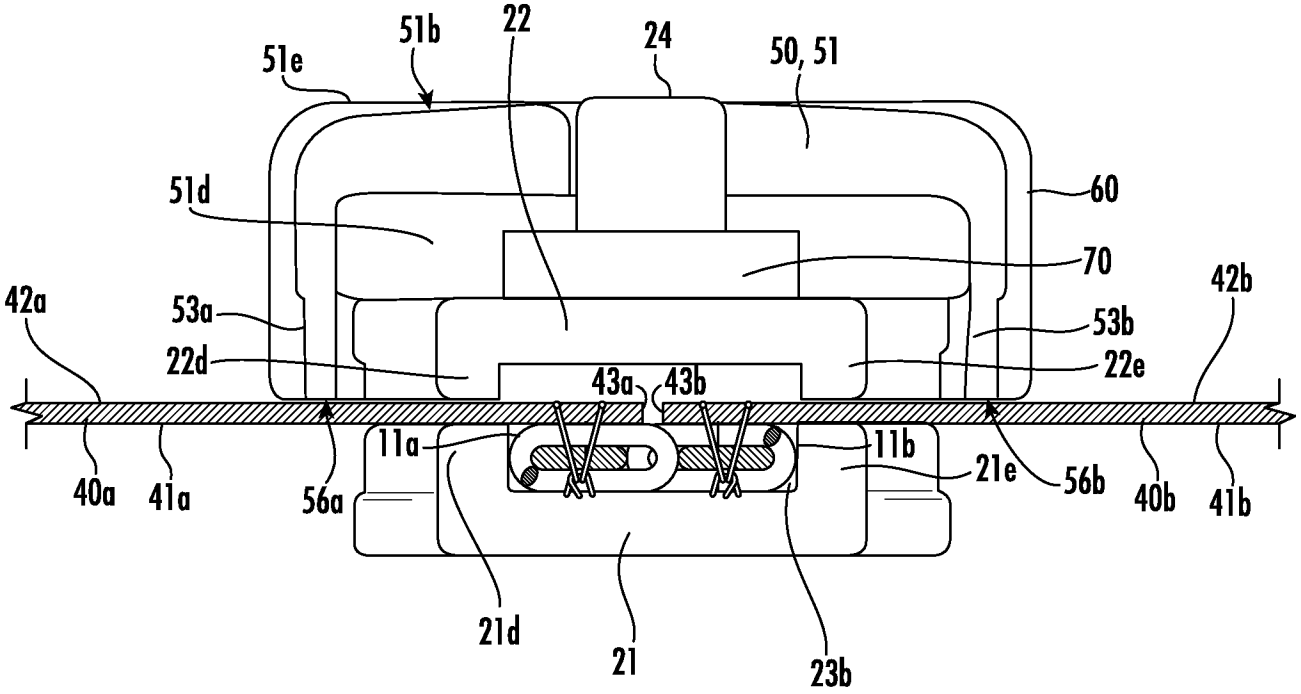
FIG. 7 illustrates a rear end view of the slide fastener shown in FIG. 1 as viewed through the X-X plane shown in FIG. 1.

The first interlocking stringer 40*a* includes a first tape 44*a* and a plurality of coupling elements 11*a*, or teeth. The first tape 44*a* has an interior surface 41*a*, an exterior surface 42*a*, and a facing edge 43*a* that extends between the interior 41*a* and exterior surfaces 42*a*. The teeth 11*a* are coupled to the interior surface 41*a* adjacent the facing edge 43*a*. The second interlocking stringer 40*b* includes a second tape 44*b* and a plurality of coupling elements 11*b*. The second tape 44*b* has an interior surface 41*b*, an exterior surface 42*b*, and a facing edge 43*b* that extends between the interior 41*b* and exterior surfaces 42*b*. The teeth 11*b* are coupled to the interior surface 41*b* adjacent the facing edge 43*b*. The facing edges 43*a*, 43*b* face each other, as shown in FIG. 7. The teeth 11*a*, 11*b* coupled to the interior surfaces 41*a*, 41*b* are not shown in FIG. 1.

Figure 13:
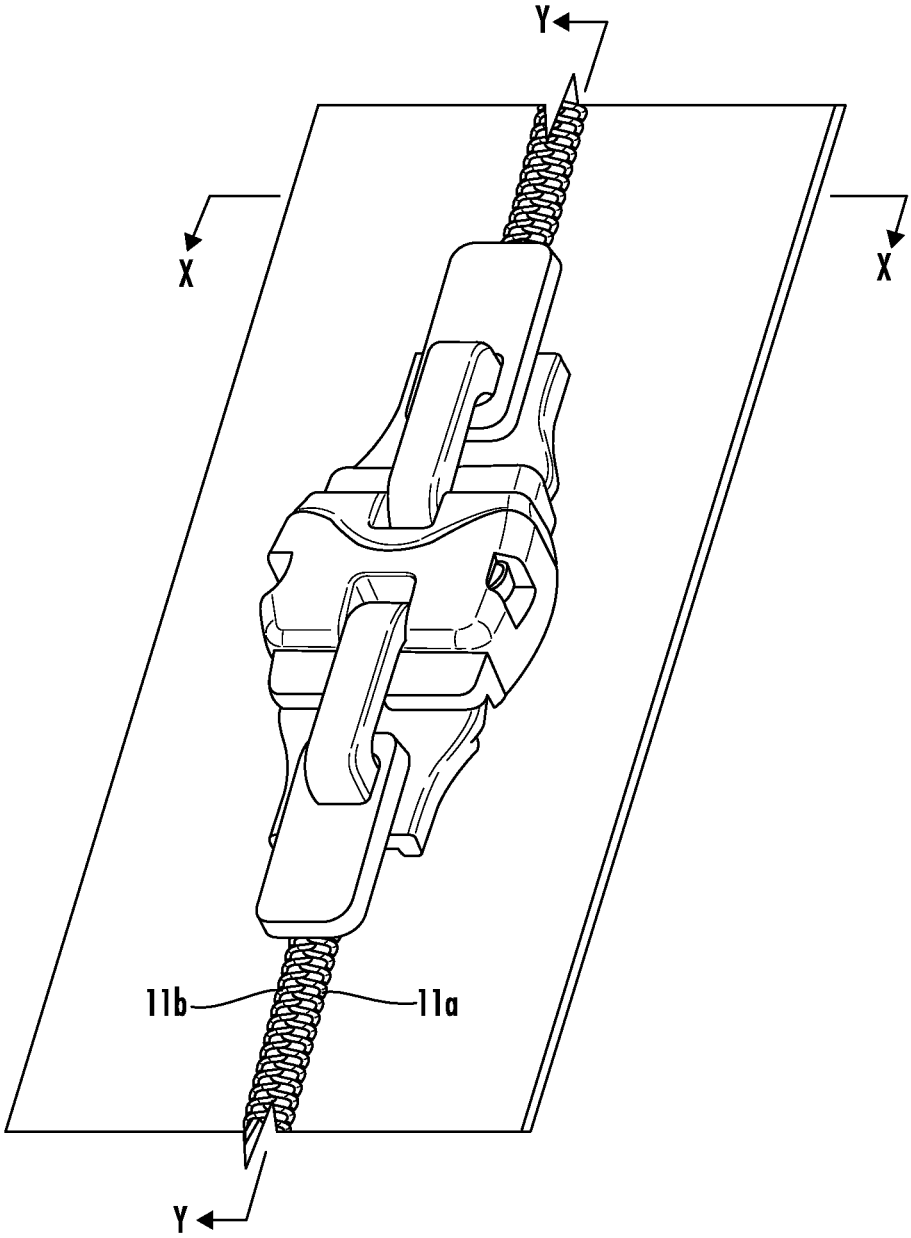
FIG. 13 illustrates a slide fastener having continuous coupling elements coupled to the exterior surfaces of the tapes, according to another implementation.

In other implementations, such as shown in FIG. 13, the coupling elements 11*a*, 11*b* are coupled to the exterior surfaces of the tapes. The interior surface 41*a* and the exterior surface 42*a* are spaced apart and face opposite directions, and the interior surface 41*b* and the exterior surface 42*b* are spaced apart and face opposite directions. The interior surfaces 41*a*, 41*b* face the same direction when the sliders 20, 30 are coupled together, and the exterior surfaces 42*a*, 42*b* face the same direction when the sliders 20, 30 are coupled together.

Although the slide fastener 10 may be generally installed in an application such that the interior surfaces 41*a*, 41*b* face an interior space defined by an object on which the slider fastener 10 is installed, other applications may not include a defined interior space, or the exterior surfaces 42*a*, 42*b* may be installed to face a defined interior space. Thus, the terms "interior" and "exterior" should not be construed to limit the use of the slide fastener or object to which the slide fastener is coupled.

Furthermore, in some implementations, the slide fastener may include a second plug slider cover coupled to the interior surface of one of the sliders and a second socket slider cover coupled to the interior surface of the other slider.

In addition, one or both of the surfaces 41*a*, 41*b*, 42*a*, 42*b* of the stringers 40*a*, 40*b* may be coated with a material that prevents a liquid from flowing through or absorbing into the stringers 40*a*, 40*b*. For example, the coating material may include polyurethane, and the material may be coated using lamination, transfer coating, bonding, or other suitable methods.

Figure 11:
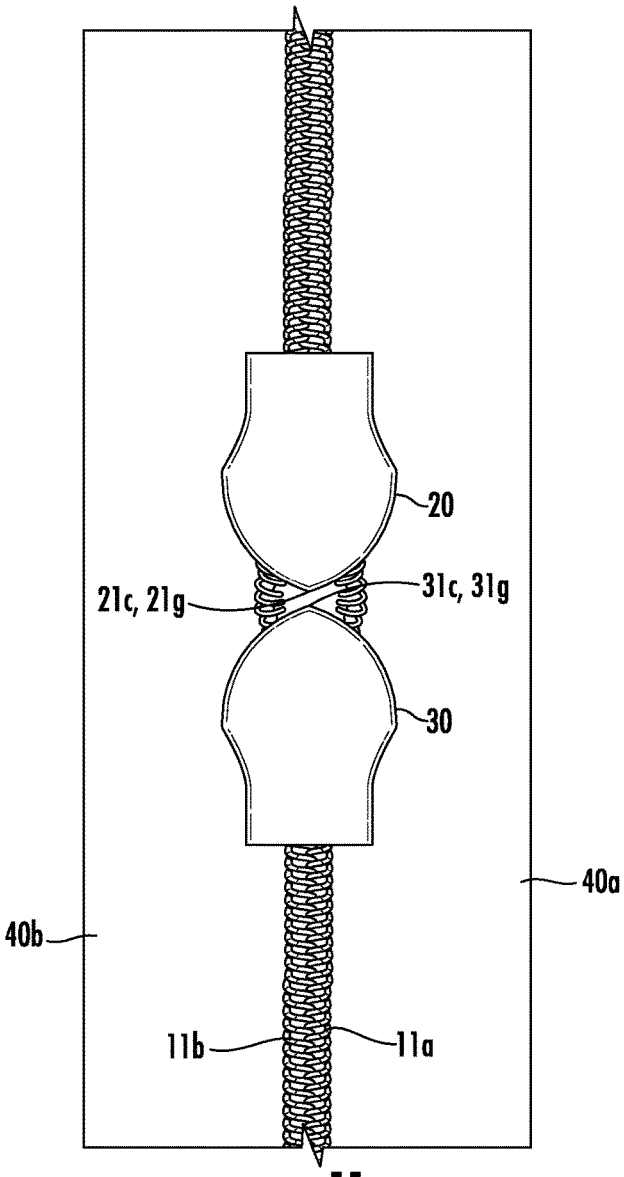
FIG. 11 illustrates an interior plan view of the slide fastener shown in FIG. 1.
Figure 12A:
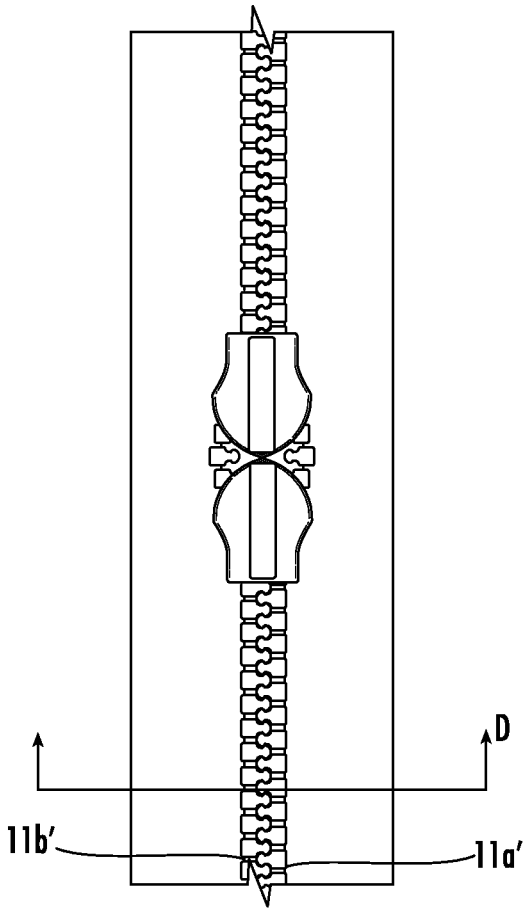
FIG. 12A illustrates a slide fastener having discontinuous teeth according to one implementation.
Figure 12B:
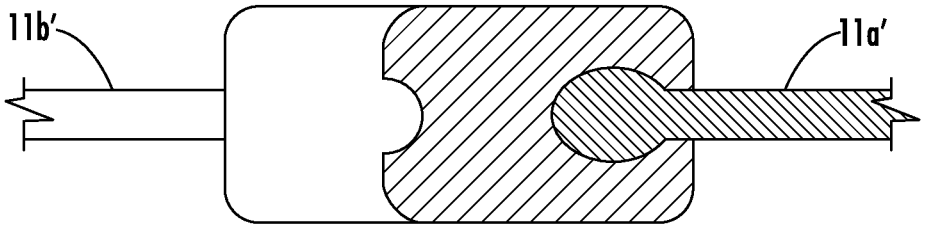
FIG. 12B illustrates a cross sectional view of the slide fastener in FIG. 12A through the D-D line.

As shown in FIGS. 1, 7, and 11, teeth 11*a*, 11*b* of the slide fastener 10 are coupled to the interior surfaces 41*a*, 41*b* of the tapes 44*a*, 44*b* adjacent the facing edges 43*a*, 43*b*, respectively, for engaging between each other when the sliders 20, 30 are moved toward each other. Teeth 11*a*, 11*b* shown in FIGS. 1, 7, and 11 are coiled, continuous teeth that are formed from a resin material. However, in other implementations, the teeth may be continuous or discontinuous and formed of a resin or metal material. FIGS. 12A-12B illustrate an implementation showing an example of discontinuous teeth 11*a*', 11*b*'. Teeth formed of a resin material may be suitable to prevent the flow of liquid through the slide fastener. In addition, discontinuous teeth, such as teeth 11*a*', 11*b*', may be coupled to both the interior and exterior surfaces of tapes along the facing edges of the tapes or to one of the interior or exterior surfaces of the tapes.

Figure 2:
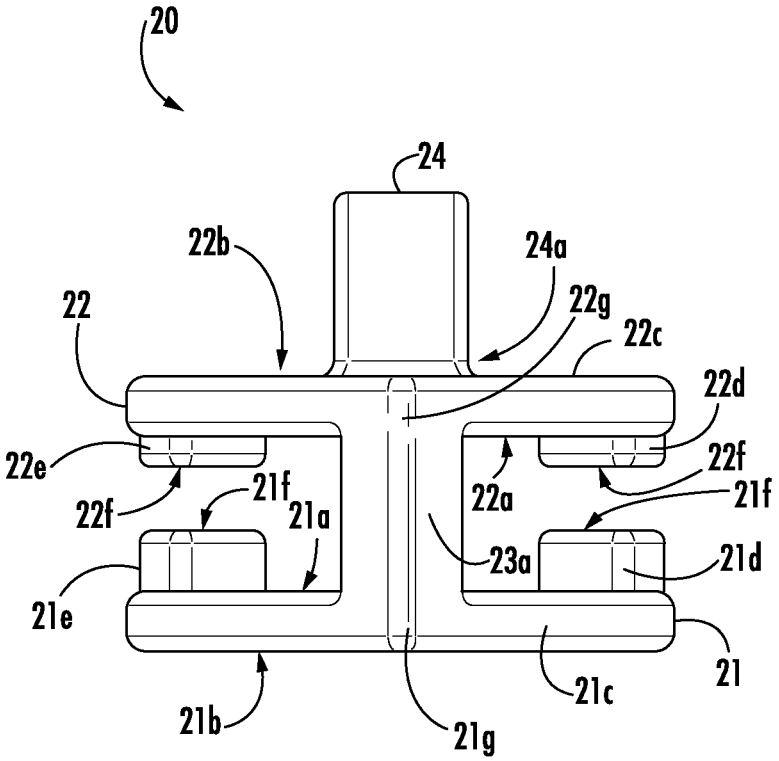
FIG. 2 illustrates a front end view of the first slider shown in FIG. 1.
Figure 3:
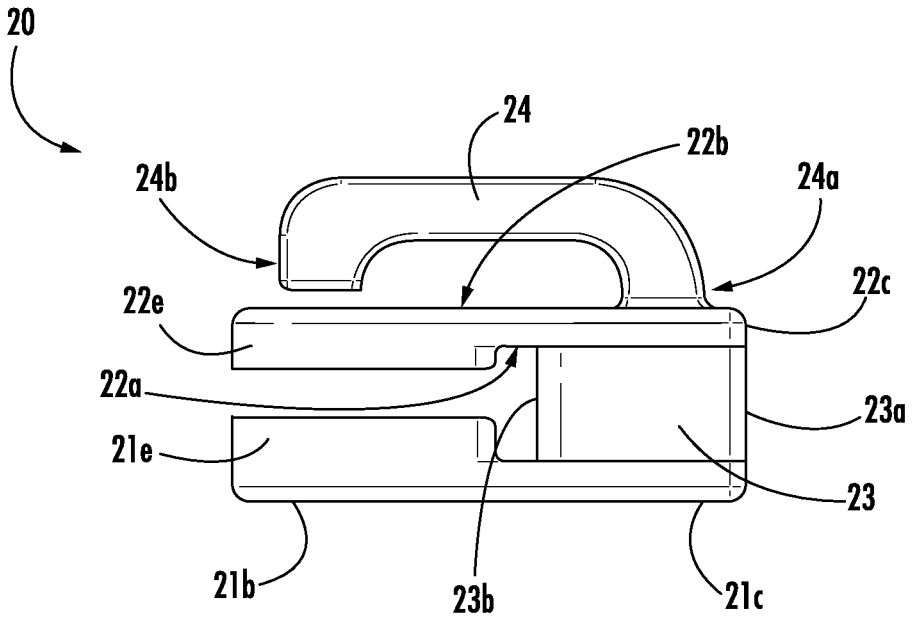
FIG. 3 illustrates a right side view of the first slider shown in FIG. 2.

As shown in FIGS. 2 and 3, the first slider 20 includes an interior wing 21, an exterior wing 22, a connecting portion 23, and a crown 24. The interior wing 21 includes a facing surface 21*a* that faces the interior surfaces 41*a*, 41*b* of the stringers 40*a*, 40*b*, respectively, an outer surface 21*b* that faces away from the stringers 40*a*, 40*b* and is opposite and spaced apart from facing surface 21*a*, a front face 21*c* that extends between the facing surface 21*a* and the outer surface 21*b* at an end of the first slider 20 that faces the second slider 30, a first lateral interior retaining flange 21*d*, and a second lateral interior retaining flange 21*e*. Each lateral interior retaining flange 21*d*, 21*e* has a distal end 21*f*. The lateral interior retaining flanges 21*d*, 21*e* extend from the facing surface 21*a* toward the interior surfaces 41*a*, 41*b* of the stringers 40*a*, 40*b*, respectively.

The exterior wing 22 includes a facing surface 22*a* that faces the exterior surfaces 42*a*, 42*b* of the stringers 40*a*, 40*b*, respectively, an outer surface 22*b* that faces away from the stringers 40*a*, 40*b* and is opposite and spaced apart from the facing surface 22*a*, a front face 22*c* that extends between the facing surface 22*a* and the outer surface 22*b* at the end of the first slider 20 that faces the second slider 30, a first lateral exterior retaining flange 22*d*, and a second lateral exterior retaining flange 22*e*. Each lateral exterior retaining flange 22*d*, 22*e* has a distal end 22*f*. The lateral exterior retaining flanges 22*d*, 22*e* extend from the facing surface 22*a* toward the exterior surfaces 42*a*, 42*b* of the stringers 40*a*, 40*b*, respectively.

The first lateral interior retaining flange 21*d* and the first lateral exterior retaining flange 22*d* extend toward each other and the interior surface 41*a* and the exterior surface 42*a*, respectively, of the first interlocking stringer 40*a* and together guide teeth on the first interlocking stringer 40*a* toward teeth on the second interlocking stringer 40*b*. The second lateral interior retaining flange 21*e* and the second lateral exterior retaining flange 22*e* extend toward each other and the interior surface 41*b* and the exterior surface 42*b*, respectively, of the second interlocking stringer 40*b* and together guide teeth on the second interlocking stringer 40*b* toward teeth on the first interlocking stringer 40*a*.

The connecting portion 23 extends between the facing surfaces 21*a*, 22*a* of the interior wing 21 and the exterior wing 22, respectively. The connecting portion 23 has a front edge 23*a* that extends between medial portions 21*g*, 22*g* of the front faces 21*c*, 22*c* of the wings 21, 22, respectively, and a rear edge 23*b* that is spaced apart and opposite from the front edge 23*a*. The rear edge 23*b* of the connecting portion 23 extends between medial portions of the facing surfaces 21*a*, 22*a*. The rear edge 23*b* of the connecting portion 23 separates teeth disposed on the facing edges 43*a*, 43*b* of the stringers 40*a*, 40*b*, respectively, when the rear edge 23*b* is pulled toward teeth that are coupled together.

The crown 24 is coupled to the outer surface 22*b* of the exterior wing 22. The crown 24 has a proximal end 24*a* that is coupled to the outer surface 22*b* and a distal end 24*b* that is adjacent to the outer surface 22*b*. The crown 24 and the outer surface 22*b* of the exterior wing 22 define an opening therebetween.

Figure 4:
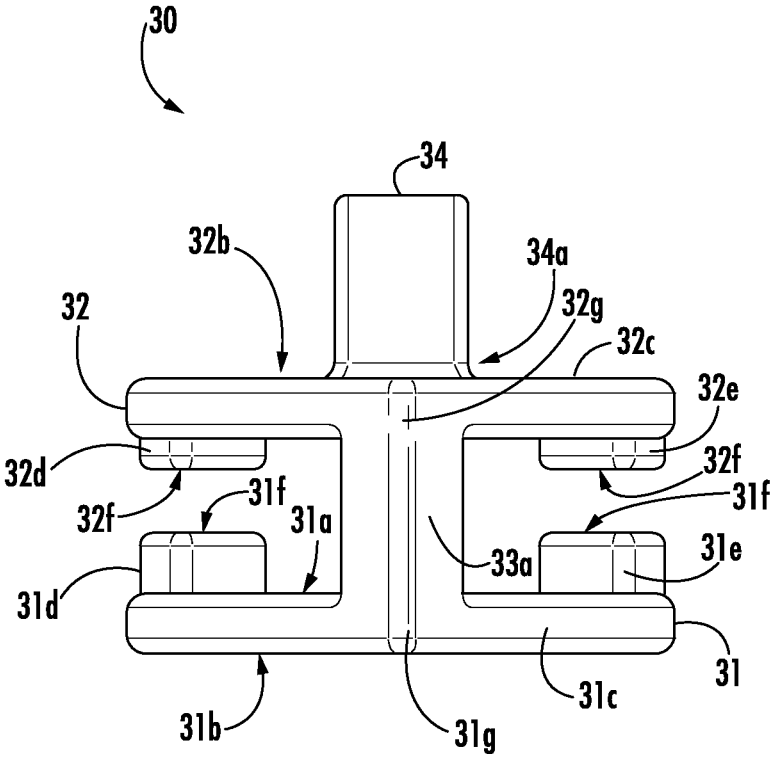
FIG. 4. illustrates a front end view of the second slider shown in FIG. 1.
Figure 5:
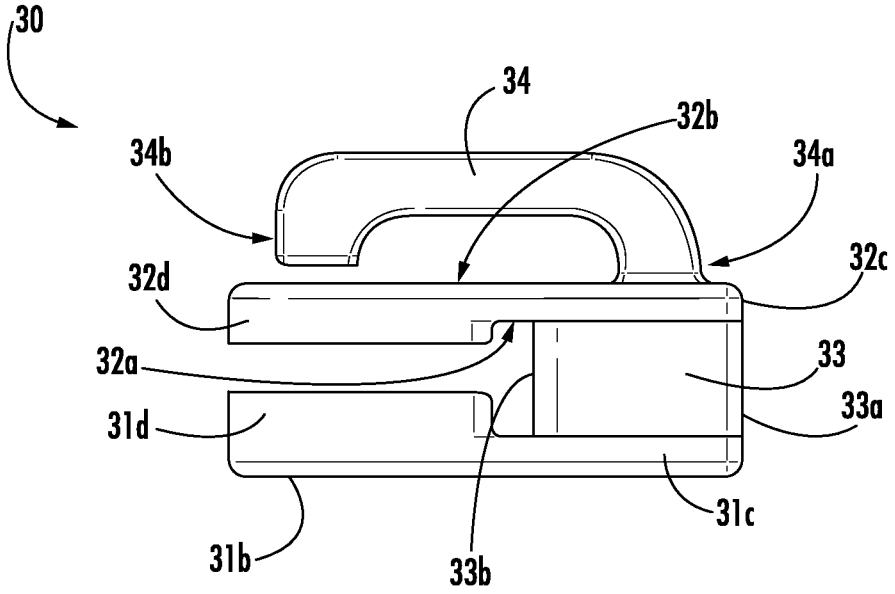
FIG. 5 illustrates a right side view of the second slider shown in FIG. 4.
Figure 6:
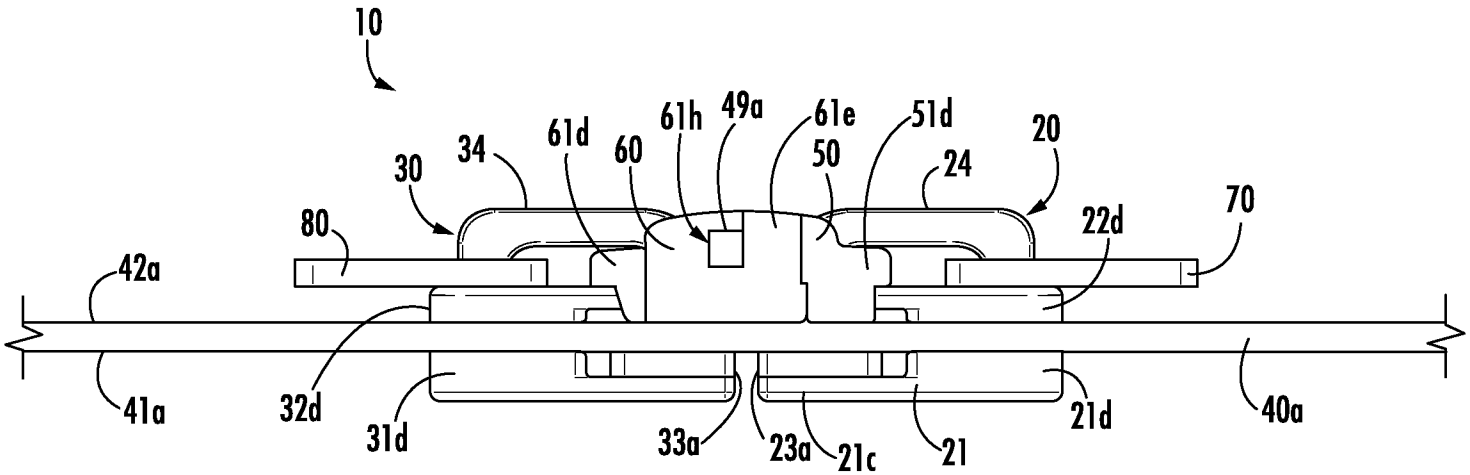
FIG. 6 illustrates a right side view of the slide fastener shown in FIG. 1. A portion of the interlocking stringer 40*a* that is not disposed within the sliders 20, 30 and the coupling elements have been removed from the view.

As shown in FIGS. 4 and 5, the second slider 30 includes an interior wing 31, an exterior wing 32, a connecting portion 33, and a crown 34. The interior wing 31 includes a facing surface 31*a* that faces the interior surfaces 41*a*, 41*b* of the stringers 40*a*, 40*b*, an outer surface 31*b* that faces away from the stringers 40*a*, 40*b* and is opposite and spaced apart from facing surface 31*a*, a front face 31*c* that extends between the facing surface 31*a* and the outer surface 31*b* at an end of the second slider 30 that faces the first slider 20, a first lateral interior retaining flange 31*d*, and a second lateral interior retaining flange 31*e*. Each lateral interior retaining flange 31*d*, 31*e* has a distal end 31*f*. The lateral interior retaining flanges 31*d*, 31*e* extend from the facing surface 31*a* toward the interior surfaces 41*a*, 41*b* of the stringers 40*a*, 40*b*, respectively.

The exterior wing 32 includes a facing surface 32*a* that faces the exterior surfaces 42*a*, 42*b* of the stringers 40*a*, 40*b*, an outer surface 32*b* that faces away from the stringers 40*a*, 40*b* and is opposite and spaced apart from the facing surface 32*a*, a front face 32*c* that extends between the facing surface 32*a* and the outer surface 32*b* at the end of the second slider 30 that faces the first slider 20, a first lateral exterior retaining flange 32*d*, and a second lateral exterior retaining flange 32*e*. Each lateral exterior retaining flange 32*d*, 32*e* has a distal end 32*f*. The lateral exterior retaining flanges 32*d*, 32*e* extend from the facing surface 32*a* toward the exterior surfaces 42*a*, 42*b* of the stringers 40*a*, 40*b*, respectively.

The first lateral interior retaining flange 31*d* and the first lateral exterior retaining flange 32*d* extend toward each other and the interior surface 41*a* and the exterior surface 42*a*, respectively, of the first interlocking stringer 40*a* and together guide teeth on the first interlocking stringer 40*a* toward teeth on the second interlocking stringer 40*b*. The second lateral interior retaining flange 31*e* and the second lateral exterior retaining flange 32*e* extend toward each other and the interior surface 41*b* and the exterior surface 42*b*, respectively, of the second interlocking stringer 40*b* and together guide teeth on the second interlocking stringer 40*b* toward teeth on the first interlocking stringer 40*a*.

The connecting portion 33 extends between the facing surfaces 31*a*, 32*a* of the interior wing 31 and the exterior wing 32, respectively. The connecting portion 33 has a front edge 33*a* that extends between medial portions 31*g*, 32*g* of the front faces 31*c*, 32*c* of the wings 31, 32, respectively, and a rear edge 33*b* that is spaced apart and opposite from the front edge 33*a*. The rear edge 33*b* of the connecting portion 33 extends between medial portions of the facing surfaces 31*a*, 32*a*. The rear edge 33*b* of the connecting portion 33 separates teeth disposed on the facing edges 43*a*, 43*b* of the stringers 40*a*, 40*b*, respectively, when the rear edge 33*b* is pulled toward teeth that are coupled together.

The crown 34 is coupled to the outer surface 32*b* of the exterior wing 32. The crown 34 has a proximal end 34*a* that is coupled to the outer surface 32*b* and a distal end 34*b* that is adjacent to the outer surface 32*b*. The crown 34 and the outer surface 32*b* of the exterior wing 32 define an opening therebetween.

Plug Slider Cover

Figure 8A:
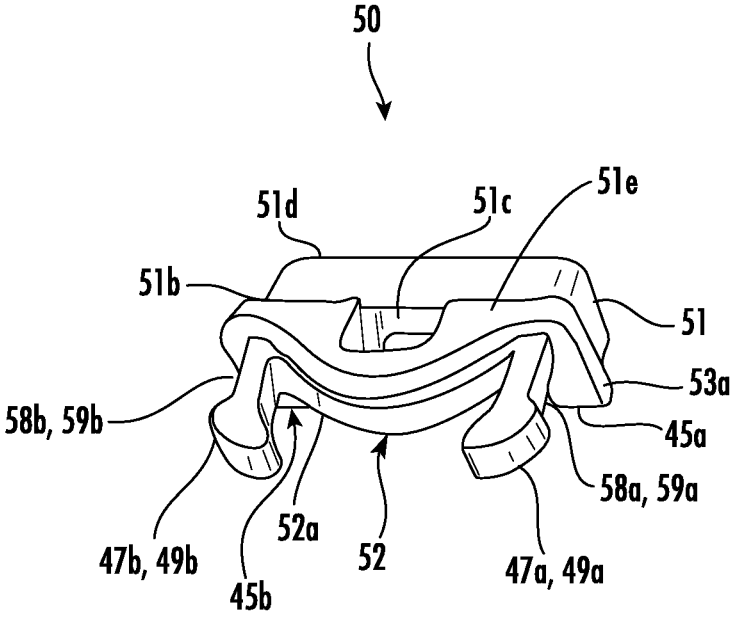
FIG. 8A illustrates an exterior perspective view of the plug slider cover shown in FIG. 1.
Figure 8B:
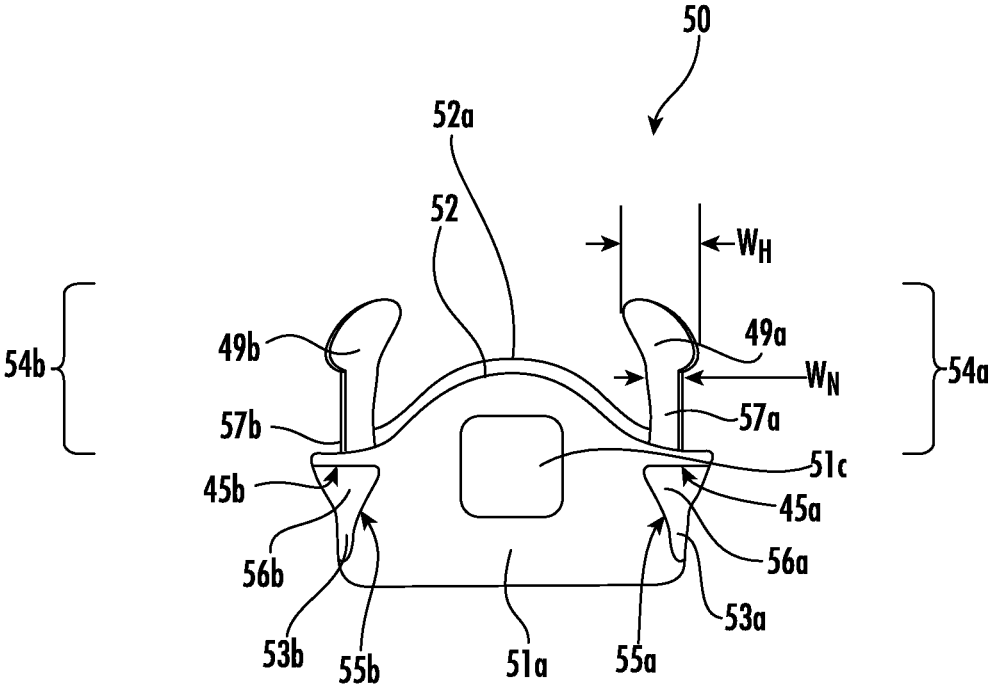
FIG. 8B illustrates an interior plan view of the plug slider cover shown in FIG. 8A.
Figure 8C:
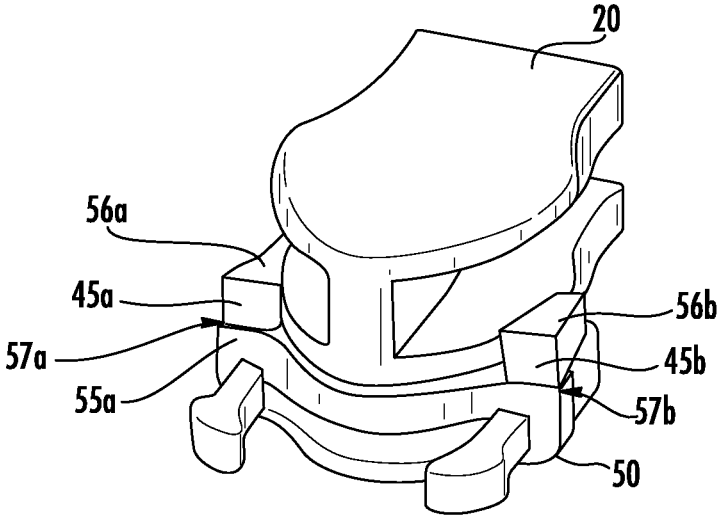
FIG. 8C illustrates an interior perspective view of the engagement of the contact face of the protrusions of the plug slider cover of FIG. 8A with the front face of the exterior wing of the first slider shown in FIG. 1.

As shown in FIGS. 8A, 8B, and 8C, the plug slider cover 50 includes a main body 51 having an inner side 51*a*, an outer side 51*b*, an engagement face 52 extending between the inner side 51*a* and the outer side 51*b*, a first plug 54*a* and a second plug 54*b* that extend from the engagement face 52, and a first lateral protrusion 53*a* and a second lateral protrusion 53*b* that each extend from the inner side 51*a* of the main body 51 toward a plane that includes the exterior surfaces 42*a*, 42*b* of the interlocking stringers 40*a*, 40*b*, respectively. The inner side 51*a* of the main body 51 of the plug slider cover 50 abuts the outer surface 22*b* of the exterior wing 22 of the first slider 20.

Each of the first and second plugs 54*a*, 54*b* includes a lateral arm 58*a*, 58*b*, respectively. Each lateral arm 58*a*, 58*b* includes a neck portion 59*a*, 59*b* and a head portion 49*a*, 49*b*, respectively. The neck portion 59*a*, 59*a* extends between the head portion 49*a*, 49*b* and the engagement face 52, respectively. The lateral arms 58*a*, 58*b* are disposed adjacent each lateral side of the engagement face 52. The neck portions 59*a*, 59*b* are biased in lateral directions and can be moved medially during engagement and disengagement with the respective lateral socket 64*a*, 64*b*, which are described below. The head portions 49*a*, 49*b* have a width $W_H$ that is greater than a width $W_N$ of the neck portions 59*a*, 59*b*, respectively. In addition, each head portion 49*a*, 49*b* has a respective lateral side 47*a*, 47*b* that is spaced apart from a plane that includes a lateral side of each respective lateral arm 58*a*, 58*b*. The lateral sides 47*a*, 47*b* of the respective head portions 49*a*, 49*b* are arcuate shaped as viewed from the outer side 51*b* or the inner side 51*a* of the main body 51. However, in other implementations, the lateral sides of the respective head portions are not arcuate shaped.

The engagement face 52 also includes a lip 52*a* that extends from and along at least a portion of the engagement face 52. The lip 52*a* is spaced apart from the outer side 51*b* and the inner side 51*a* of the main body 51 of the plug slider cover 50. For example, the lip 52*a* may extend from a medial portion of the engagement face 52 between the lateral arms 58*a*, 58*b*. In the implementation shown, the lip 52*a* extends across the engagement face 52 and intersects with the proximal ends of the neck portions 59*a*, 59*b* of the respective lateral arms 58*a*, 58*b*. But, in other implementations, the lip 52*a* may not intersect the proximal ends 59*a*, 59*b* of the respective neck portions 59*a*, 59*b*.

In the implementation shown, the engagement face 52 has an arcuate shape as viewed from the outer side 51*b* or the inner side 51*a* of the main body 51, but in other implementations, the shape and contour of the engagement face 52 may change depending on the shape and contour of an engagement face 62 of the socket slider cover 60, which are described below. For example, in some implementations, the engagement face 52 may have one more planar shaped portions, or the engagement face 52 may have at least one arcuate shaped portion and at least one planar shaped portions.

As shown in FIGS. 8B-8E, each of the first and second lateral protrusions 53*a* and 53*b* includes a contact face 55*a*, 55*b*, distal ends 56*a*, 56*b*, proximal ends 57*a*, 57*b*, and engagement faces, 45*a*, 45*b*, respectively. The proximal ends 57*a*, 57*b* are coupled to the inner side 51*a* of the main body 51, and the distal ends 56*a*, 56*b* are spaced apart from the proximal ends 57*a*, 57*b*, respectively. The contact face 55*a* and the engagement face 45*a* lie in different planes and extend between the proximal end 57*a* and the distal end 56*a*, and the contact face 55*b* and the engagement face 45*b* lie in different planes and extend between the proximal end 57*b* and the distal end 56*b*. In this implementation, the distal ends 56*a*, 56*b* lie within a plane that is coplanar with distal ends 22*f* of the first 22*d* and second lateral exterior retaining flanges 22*e*. However, in other implementations, the distal ends 56*a*, 56*b* may lie in a plane that is spaced apart from a plane that includes the distal ends 22*f* of the first 22*d* and second lateral exterior retaining flanges 22*e*.

The distal ends 56*a*, 56*b* may contact the exterior surfaces 42*a*, 42*b* of the interlocking stringers 40*a*, 40*b*, respectively, if exterior surfaces 42*a*, 42*b* are coplanar. Since the stringers 40*a*, 40*b* may be made from a flexible material, such as a fabric, the extent to which the distal ends 56*a*, 56*b* contact the exterior surfaces 42*a*, 42*b* may vary depending on forces incident on the stringers 40*a*, 40*b*.

The contact faces 55*a*, 55*b* of the lateral protrusions 53*a*, 53*b*, respectively, abut at least a portion of the front face 22*c* of the exterior wing 22 of the first slider 20. The abutment of the contact faces 55*a*, 55*b* with the front face 22*c* and the abutment of contact faces 65*a*, 65*b* with the front face 32*c* prevents wobbling and twisting of the plug slider cover 50 and the socket slider cover 60 during engagement and disengagement of the covers 50, 60, respectively. For example, the wobbling or twisting may occur about an axis that extends through the inner side 51*a* and the outer side 51*b* of the main body 51. In this implementation, the protrusions 53*a*, 53*b* are biased in a medial direction toward the portions of the front face 22*c* that they abut. FIG. 8C illustrates the plug slider cover 50 coupled to the first slider 20 and the contact face 55*a* biased against the front face 22*a* of the first slider 20. And, FIG. 8D illustrates the tapered contact faces 55*a*, 55*b* of the protrusions 53*a*, 53*b*. At least a portion of each contact face 55*a*, 55*b* lies within a plane that extends at an angle θ that is greater than 0° and less than 90° relative to a plane that is orthogonal to the inner side 51*a* of the main body 51 and extends through the respective protrusion 53*a*, 53*b*. However, in other implementations, such as shown in FIG. 8F, the contact faces 55*a*', 55*b*' are not tapered and biased against the front face 22*a* of the first slider 20. The contact faces 55*a*, 55*b* have an arcuate shape as viewed from the inner side 51*a* of the main body 51. The arcuate shape of each contact face 55*a*, 55*b* has a radius of curvature that corresponds to a radius of curvature of the respective portions of the front face 22*c* that the contact faces 55*a*, 55*b* engage. However, in other implementations, the contact faces 55*a*, 55*b* may be planar shaped or they may have a contour that corresponds to a contour of the respective portions of the front faces 22*c* that they abut.

The engagement faces 45*a*, 45*b* of the protrusions 53*a*, 53*b*, respectively, face a direction toward the second slider 30.

Figure 8E:
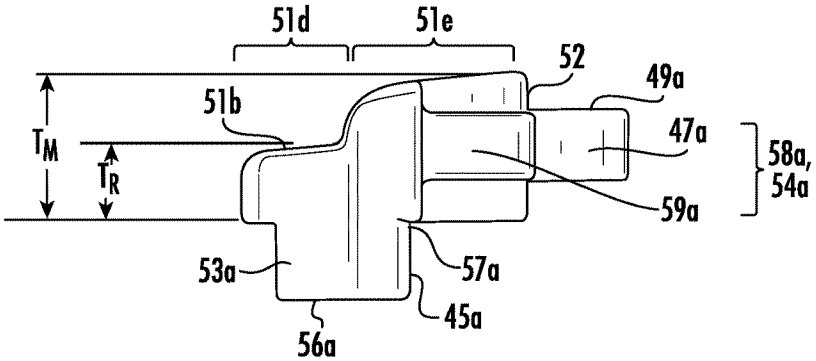
FIG. 8E illustrates a right side view of the plug slider cover shown in FIG. 8A.
Figure 8G:
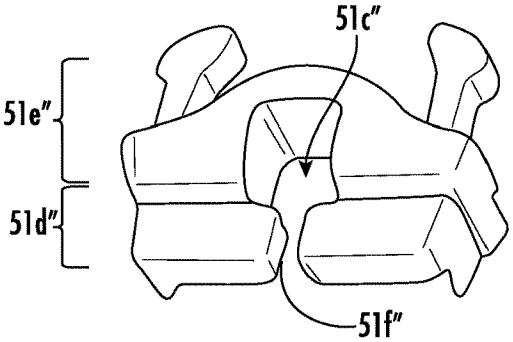
FIG. 8G illustrates an exterior perspective view of a plug slider cover according to another implementation.
Figure 8D:
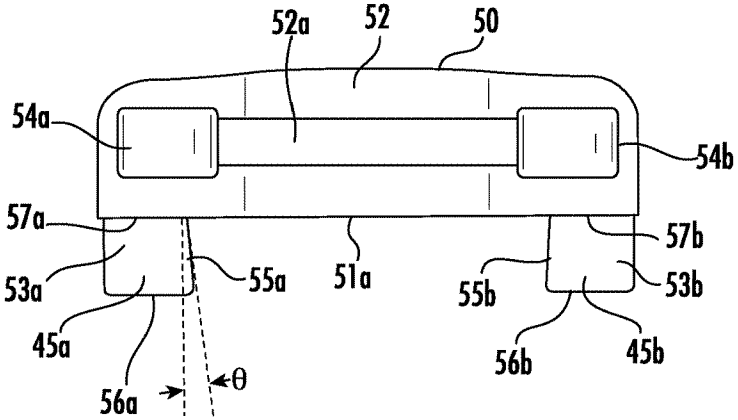
FIG. 8D illustrates a front end view of the plug slider cover shown in FIG. 8A.
Figure 8F:
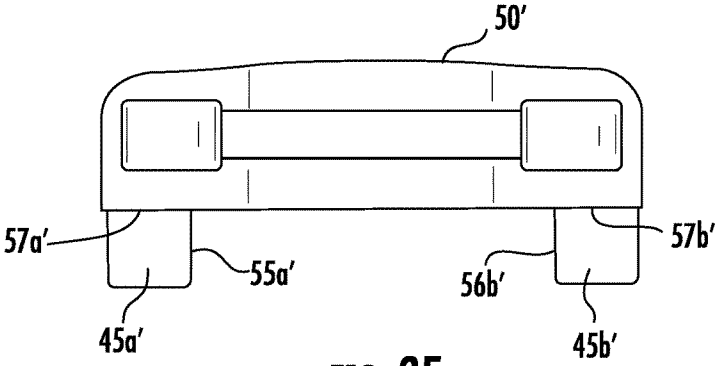
FIG. 8F illustrates a plug slider cover according to another implementation that has protrusions that are not biased toward the slider.
Figure 9A:
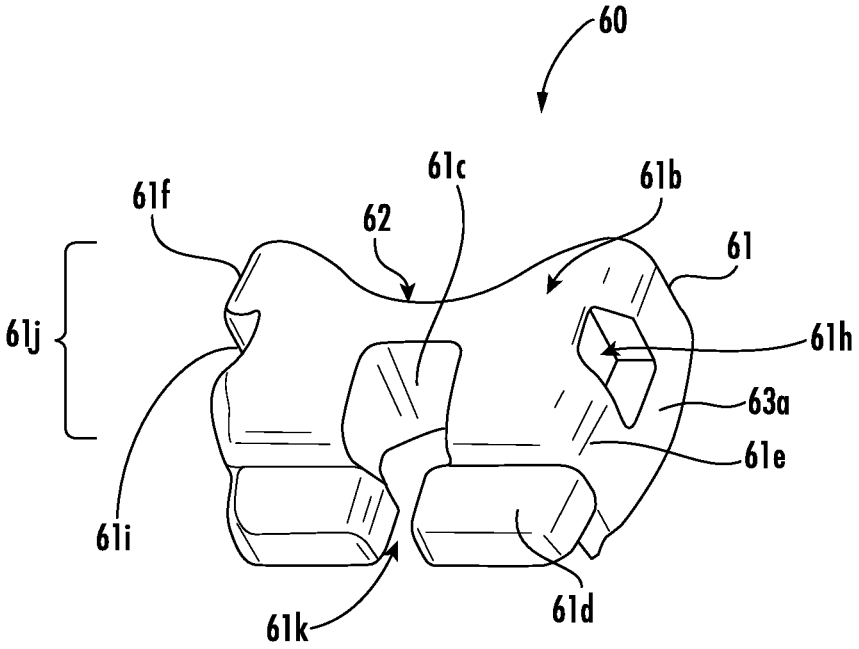
FIG. 9A illustrates an exterior perspective view of the socket slider cover shown in FIG. 1.
Figure 9B:
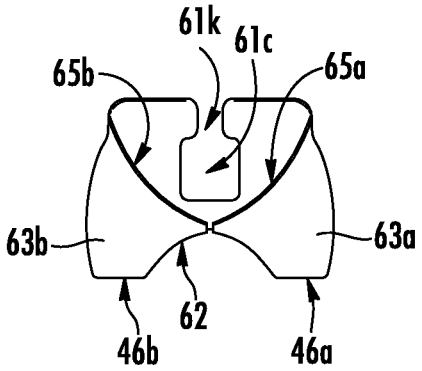
FIG. 9B illustrates an interior plan view of the socket slider cover shown in FIG. 9A.
Figure 9C:
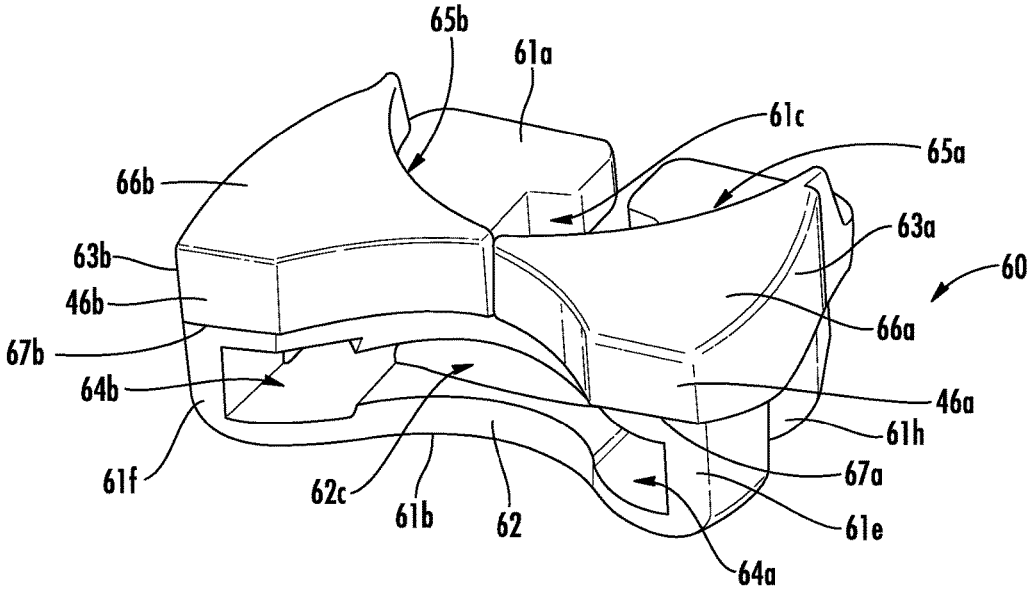
FIG. 9C illustrates an interior perspective view of the socket slider cover shown in FIG. 9A.
Figure 9D:
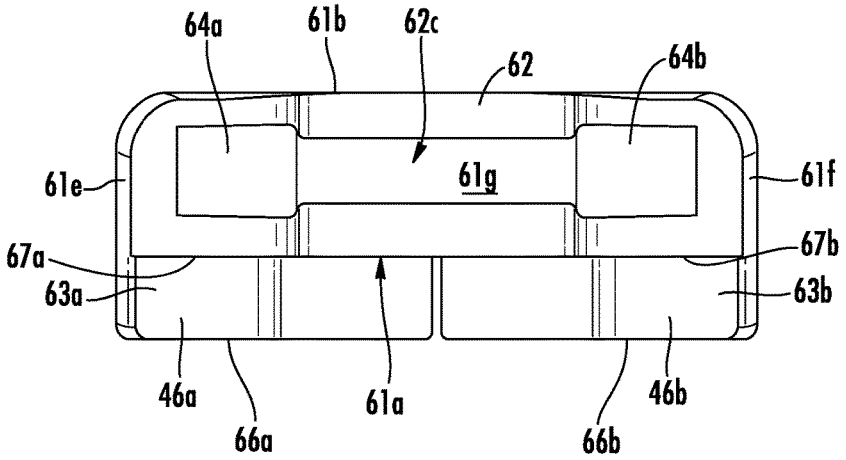
FIG. 9D illustrates a front end view of the socket slider cover shown in FIG. 9A.
Figure 9E:
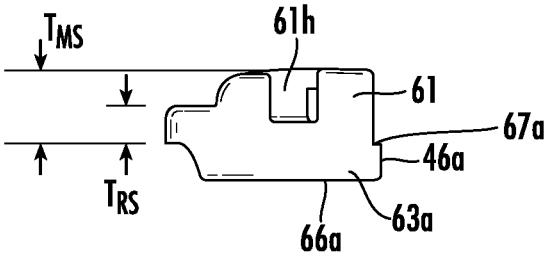
FIG. 9E illustrates a right side view of the socket slider cover shown in FIG. 10.
Figure 9F:
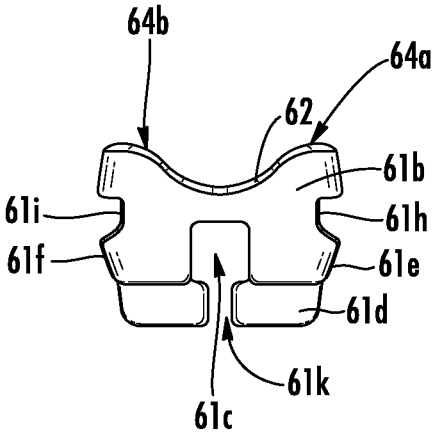
FIG. 9F illustrates an exterior plan view of the socket slider cover shown in FIG. 9A.
Figure 10:
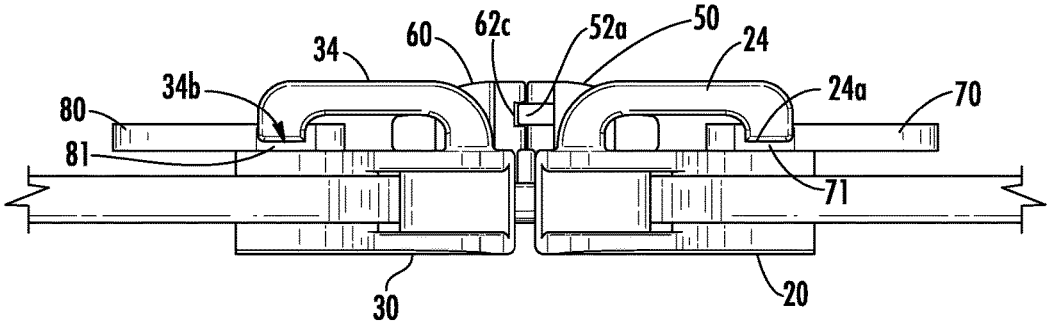
FIG. 10 illustrates a cross sectional view of the slide fastener as taken through the Y-Y plane shown in FIG. 1. The coupling elements have been removed from this view.

As shown in FIGS. 8A and 8E, the main body 51 of the plug slider cover 50 further includes a front portion 51*e* and a rear portion 51*d* that is opposite and spaced apart from the engagement face 52. The front portion 51*e* is disposed between the rear portion 51*d* and the engagement face 52. The rear portion 51*d* has a thickness $T_R$ that is less than a thickness $T_M$ of the front portion 51*e*, wherein thickness is measured in a direction of the axis that extends through the inner side 51*a* and the outer side 51*b* of the main body 51. In addition, the inner side 51*a* and the outer side 51*b* of the main body 51 define an opening 51*c* that extends through the main body 51. In the implementation shown, a portion of the opening 51*c* is defined through the rear portion 51*d* and a portion of the opening 51*c* is defined through the front portion 51*e*. In addition, as shown, the perimeter of the opening 51*c* is closed. However, in other implementations, such as is shown in FIG. 8G, an opening 51*c*" may not have a closed perimeter. In FIG. 8G, the rear portion 51*d* defines a slot 51*f*" (or break) along a length thereof that is in communication with the opening 51*c*" such that the perimeter of the opening 51*c*" is not closed. In addition, in other implementations, the opening 51*c* may be defined through the front portion 51*e* alone, through rear portion 51*d* alone, or the main body 51 may not include a rear portion 51*d* that has a reduced thickness as compared to the front portion 51*e*.

The implementations shown in FIGS. 1-12B include first and second plugs, but other implementations may include one or more plugs. For example, in some implementations, one plug extends from a medial portion of the engagement face of the plug slider cover. In some implementations, the plug may include two or more arms each having a neck and a head portion, and in other implementations, the plug may include one arm having a neck and a head portion. And, in other implementations, three or more plugs may be provided. For example, the plug slider cover may include two lateral plugs and a medial plug.

Furthermore, in other implementations, the inner side of the plug slider cover is disposed adjacent and spaced apart from the outer surface of the exterior wing of the first slider, and a frictional interface between one or more protrusions that are biased toward the front face of the exterior wing and the one or more portions of the front face that are engaged by the one or more protrusions prevent unintended movement of the plug slider cover away from the outer surface of the exterior wing.

Two lateral protrusions are described above in the above described implementation. However, other implementations may include one or more protrusions that extend from the inner side 51*a* of the main body 51. For example, in one implementation, one protrusion extends from a medial portion of the inner side of the main body of the plug slider cover and has a contact surface that abuts each side of the medial portion 22*g* of the front face 22*c* of the exterior wing 22 of the slider 20. In another implementation, three or more protrusions extend from the inner side 51*a* of the main body 50.

Socket Slider Cover

As shown in FIGS. 9A-9F, the socket slider cover 60 includes a main body 61 having an inner side 61*a* and an outer side 61*b*, the engagement face 62 that extends between the inner side 61*a* and the outer side 61*b* of the main body 61 of the socket slider cover 60, and first and second lateral protrusions 63*a*, 63*b* that extend from the inner side 61*a* of the main body 61 of the socket slider cover 60 toward a plane that includes the exterior surfaces 42*a*, 42*b* of the interlocking stringers 40*a*, 40*b*. The inner side 61*a* of the main body 51 of the socket slider cover 60 abuts the outer surface 32*b* of the exterior wing 32 of the second slider 30.

The main body 61 further includes lateral walls 61*e*, 61*f* and a medial wall 61*g* that extend between the inner side 61*a* and the outer side 61*b* of the main body 61. The medial wall 61*g* is disposed between and spaced apart from the lateral walls 61*e*, 61*f*. In addition, the medial wall 61*g* is spaced apart from and rearwardly relative to the engagement face 62.

As shown in FIGS. 9A, 9C, 9D, and 9F, the engagement face 62 of the main body 61 of the socket slider cover 60 defines a first lateral socket 64*a* and a second lateral socket 64*b*. The first lateral socket 64*a* is further defined by the lateral wall 61*e*, inner side 61*a*, outer side 61*b*, and one lateral facing edge of the medial wall 61*g*, and the second lateral socket 64*b* is further defined by the lateral wall 61*f*, the inner side 61*a*, the outer side 61*b*, and the other lateral facing edge of the medial wall 61*g*. Each of the lateral walls 61*e*, 61*f* further defines openings 61*h*, 61*i*, respectively, through a portion thereof. However, in other implementations, the lateral walls 61*e*, 61*f* may define recesses extending from a medial facing side of each lateral wall 61*e*, 61*f* but that do not extend through the lateral wall 61*e*, 61*f* completely.

In the implementation shown, the engagement face 62 has an arcuate shape as viewed from the outer side 61*b* or the inner side 61*a* of the main body 61, but in other implementations, the shape and contour of the engagement face 62 may change depending on the shape and contour of the engagement face 52 of the plug slider cover 50. For example, in some implementations, the engagement face 62 may have a planar shape, or the engagement face 62 may have at least one arcuate shaped portion and one or more planar shaped portions.

The engagement face 62 of the socket slider cover 60 also defines a channel 62*c* that is in communication with the first lateral socket 64*a* and the second lateral socket 64*b*. The channel 62*c* receives the lip 52*a* of the engagement face 52 of the plug slider cover 50 when the plugs 54*a*, 54*b* are engaged with the respective sockets 64*a*, 64*b*.

Each of the first and second lateral protrusions 63*a*, 63*b* include the contact face 65*a*, 65*b*, distal ends 66*a*, 66*b*, proximal ends 67*a*, 67*b*, and engagement faces 46*a*, 46*b*, respectively. The proximal ends 67*a*, 67*b* are coupled to the inner side 61*a* of the main body 61, and the distal ends 66*a*, 66*b* are spaced apart from the proximal ends 67*a*, 67*b*. The contact face 65*a* and the engagement face 46*a* lie in different planes and extend between the proximal end 67*a* and the distal end 66*a*, and the contact face 65*b* and the engagement face 46*b* lie in different planes and extend between the proximal end 67*b* and the distal end 66*b*. The distal ends 66*a*, 66*b* may contact the exterior surfaces 42*a*, 42*b* of the interlocking stringers 40*a*, 40*b*, respectively, if the exterior surfaces 42*a*, 42*b* are coplanar. Since the stringers 40*a*, 40*b* may be made from a flexible material, such as a fabric, the extent to which the distal ends 66*a*, 66*b* contact the exterior surfaces 42*a*, 42*b* may vary depending on forces incident on the stringers 40*a*, 40*b*.

The contact faces 65*a*, 65*b* of the lateral protrusions 63*a*, 63*b*, respectively, abut at least a portion of the front face 32*c* of the exterior wing 32 of the of the second slider 30. The contact faces 65*a*, 65*b* have an arcuate shape as viewed from the inner side 61*a* of the main body 61. The arcuate shape of each contact face 65*a*, 65*b* has a radius of curvature that corresponds to a radius of curvature of the respective portions of the front face 32*c* that the contact face 65*a*, 65*b* abut. However, in other implementations, the contact faces 65*a*, 65*b* may be planar shaped or they may have a contour that corresponds to a contour of the respective portions of the front faces 32*c* that they abut.

In the implementation of the socket slider cover 60 shown in FIGS. 9A-9F, the protrusions 63*a*, 63*b* are not tapered or biased toward the slider 30. However, in other implementations, the protrusions may be tapered and biased toward the slider 30, as is described above in relation to the plug slider cover 50.

The engagement faces 46*a*, 46*b* of the protrusions 63*a*, 63*b*, respectively, face a direction toward the first slider 20.

The main body 61 further includes a front portion 61*j* and a rear portion 61*d* that is opposite and spaced apart from the engagement face 62. The front portion 61*j* is disposed between the rear portion 61*d* and the engagement face 62. The rear portion 61*d* has a thickness $T_{RS}$ that is less than a thickness $T_{MS}$ of the front portion 61*j*. In addition, the inner side 61*a* and the outer side 61*b* of the main body 61 define an opening 61*c* that extends through the main body 61. In the implementation shown, a portion of the opening 61*c* is defined through the rear portion 61*d* and a portion of the opening 61*c* is defined through the front portion 61*j*. In addition, as shown, the perimeter of the opening 61*c* is not closed. In this implementation, the rear portion 61*d* defines a slot 61*k* (or break) along a length thereof that is in communication with the opening 61*c* such that the perimeter of the opening 61*c* is not closed. However, in other implementations, the opening 61*c* may have a closed perimeter, as is shown with respect to opening 51*c*. In addition, in other implementations, the opening 61*c* may be defined through the front portion 61*j* alone, through rear portion 61*d* alone, or the main body 61 may not include a rear portion 61*d* that has a reduced thickness as compared to the front portion 61*j*.

The above described implementation includes first and second sockets, but other implementations may include one or more sockets. For example, in some implementations, the lateral walls, the inner side, and the outer side of the main body of the socket slider cover may define one socket that receives one or more plugs. In one implementation, the medial wall 61*g* may be omitted from the main body of the socket slider cover. In other implementations, the socket slider cover may define three or more sockets that each receive one or more plugs.

In addition, in the above described implementation, the lateral walls of the main body define openings through a portion thereof. However, in further or other implementations, the lateral walls may define recesses on medial facing surfaces of the lateral walls that each receive a portion of one or more head portions of one or more plugs. And, in other implementations, the medial wall, inner side, and/or outer side of the main body of the socket slider cover may define openings and/or recesses to receive a portion of one or more head portions of one or more plugs. The openings and/or recesses on the medial wall may be provided in combination with or instead of the openings and/or recesses on the lateral walls, inner side, and/or outer side.

In other implementations, the inner side of the socket slider cover is disposed adjacent and spaced apart from the outer surface of the exterior wing of the second slider, but a frictional interface between one or more protrusions that are biased toward the front face of the exterior wing and the one or more portions of the front face that are engaged by the one or more protrusions prevent unintended movement of the socket slider cover away from the outer surface of the exterior wing.

Two lateral protrusions are described above in the above described implementation of the socket slider cover. However, other implementations may include one or more protrusions. For example, in one implementation, one protrusion extends from a medial portion of the inner side of the main body of the socket slider cover and has a contact surface that abuts each side of the medial portion 32*g* of the front face 32*c* of the exterior wing 32 of the slider 30. In another implementation, three or more protrusions extend from the inner side of the main body.

Methods of Assembly and Use

In some implementations, the plug slider cover 50 and the socket slider cover 60 comprise one or more polymer resin-based materials. For example, in some implementation, at least the engagement faces 52, 62, the lip 52*a* and channel 62*c*, the protrusions 53*a*, 53*b*, 63*a*, 63*b*, and the rear portions 51*d*, 61*d* of the slider covers 50, 60 are formed from a compressible material. For example, the compressible material may include thermoplastic polyurethane, silicon, an elastomeric polymer, or rubber. The compressible material may include a resiliently deformable material. In one implementation, the remaining portions of the slider covers 50, 60 are formed of a stiffer resin material, such as polyacetal or nylon, to provide more strength. However, in other implementations, the covers 50, 60 may be made out of one material.

To assemble the slide fastener 10, the first slider 20 and the second slider 30 are disposed astride facing edges 43*a*, 43*b* of the first 40*a* and the second interlocking stringer 40*b*. The teeth on the stringer 40*a* are disposed between the first lateral interior 21*d* and first lateral exterior retaining flanges 22*d* of the first slider 20, and the teeth on the stringer 40*b* are disposed between the second lateral interior 21*e* and second lateral exterior retaining flanges 22*e* of the first slider 20. In addition, the teeth on the stringer 40*a* are disposed between the first lateral interior 31*d* and first lateral exterior retaining flanges 32*d* of the second slider 30, and the teeth on the stringer 40*b* are disposed between the second lateral interior 31*e* and the second lateral exterior retaining flanges 32*e* of the second slider 30. The connecting portions 23, 33 are disposed between the facing edges 43*a*, 43*b* of the respective stringers 40*a*, 40*b*. The front faces 21*c*, 22*c* of the first slider 10 face the front faces 31*c*, 32*c* of the second slider 20.

Before or after the slider 20 is disposed astride the facing edges 43*a*, 43*b* of the first 40*a* and the second interlocking stringers 40*b*, the distal end 24*b* of the crown 24 is extended through the opening 51*c* of the plug slider cover 50, and the inner side 51*a* of the main body 51 of the plug slider cover 50 is urged against the outer surface 22*b* of the exterior wing 22 of the first slider 20. After the crown 24 of the first slider 20 is extended through the opening 51*c*, the distal end 24*b* of the crown 24 is extended through an opening 71 defined in the pull tab 70. The distal end 24*b* of the crown 24 is then urged toward the outer surface 22*b* of the exterior wing 22 of the first slider 20 to compress the rear portion 51*d* of the plug slider cover 50 between the crown 24 and the outer surface 22*b* of the exterior wing 22 and to secure the pull tab 70 to the crown 24.

Similarly, before or after the slider 30 is disposed astride the facing edges 43*a*, 43*b* of the first 40*a* and the second interlocking stringers 40*b*, the distal end 34*b* of the crown 34 is extended through the opening 61*c* of the socket slider cover 60, and the inner side 61*a* of the main body 61 of the socket slider cover 60 is urged against the outer surface 32*b* of the exterior wing 32 of the second slider 30. After the crown 34 of the second slider 30 is extended through the opening 61*c*, the distal end 34*b* of the crown 34 is extended through an opening 81 defined in a pull tab 80. The distal end 34*b* of the crown 34 is then urged toward the outer surface 32*b* of the exterior wing 32 of the second slider 30 to compress the rear portion 61*d* of the plug slider cover 60 between the crown 34 and the outer surface 32*b* of the exterior wing 32 and to secure the pull tab 80 to the crown 34.

The contact faces 55*a*, 55*b* of respective first 53*a* and second lateral protrusions 53*b* of the plug slider cover 50 abut at least a portion of the front face 22*c* of the exterior wing 22 of the first slider 20, and the engagement faces 45*a*, 45*b* of the respective lateral protrusions 53*a*, 53*b* face the second slider 30.

Similarly, the contact faces 65*a*, 65*b* of the respective first 63*a* and second lateral protrusions 63*b* of the socket slider cover 60 abut at least a portion of the front face 32*c* of the exterior wing 32 of the second slider 30, and the engagement faces 46*a*, 46*b* of the respective lateral protrusions 63*a*, 63*b* face the first slider 20.

To engage the slider covers 50, 60, the first slider 20 and the second slider 30 are urged toward each other along the stringers 40*a*, 40*b*, and to disengage the slider covers 50, 60, the sliders 20, 30 are urged away from each other along the stringers 40*a*, 40*b*. For example, the sliders 20, 30 may both be moved toward each other, or just one of the sliders 20, 30 may be moved toward the other slider 20, 30. To move the sliders 20, 30 according to one implementation, the respective pull tabs 70, 80 may be pulled or pushed in the direction of intended movement or the sliders 20, 30 may be pulled or pushed directly in the direction of intended movement. In other implementations, one or more of pull tabs 70, 80 are not included, and the sliders 20, 30 may be pulled or pushed directly in the direction of intended movement.

As the slider covers 50, 60 are urged toward each other, the first and second plugs 54*a*, 54*b* of the plug slider cover 50 engage the first lateral socket 64*a* and the second lateral socket 64*b*, respectively, of the socket slider cover 60. In particular, the lateral sides 47*a*, 47*b* of the respective head portions 49*a*, 49*b* abut the lateral walls 61*e*, 61*f* of the main body 61 of the socket slider cover 60, and as the head portions 49*a*, 49*b* move through the first lateral socket 64*a* and the second lateral socket 64*b*, respectively, the lateral walls 61*e*, 61*f* urge the head portions 49*a*, 49*b* medially. When the head portion 49*a*, 49*b* and the openings 61*h*, 61*i*, respectively, align, the first 58*a* and second lateral arms 58*b* are allowed to move back laterally away from each other, which causes the head portions 49*a*, 49*b* to engage the openings 61*h*, 61*i*, respectively. This full engagement of the covers 50, 60 prevents unintentional movement of the sliders 20, 30 away from each other. In addition, movement of the covers 50, 60 toward each other urges the lip 52*a* into the channel 62*c* and urges engagement faces 45*a*, 45*b* to abut engagement faces 46*a*, 46*b*, respectively. The engagement of the lip 52*a* into channel 62*c* and the abutment of the engagement faces 45*a*, 45*b*, 46*a*, 46*b* allows an inner side of the covers 50 to define a cavity with the portions of the stringers 40*a*, 40*b* that are between the front faces 22*c*, 32*c* of the sliders 20, 30, respectively, and liquid is prevented from flowing between inner sides of the covers 50, 60 and outer sides of the covers 50, 60. In other implementations, the engagement faces 52, 62 may include surfaces features other than a lip and channel that engage each other, or the engagement faces 52, 62 may abut against each other to seal an interface therebetween. Furthermore, in other implementations, there may be a small gap between at least a portion of the engagement faces 52, 62 due to manufacturing conditions.

The lateral arms 58*a*, 58*b* of the plugs 54*a*, 54*b*, respectively, of the plug slider cover 50 disengage the lateral sockets 64*a*, 64*b* of the socket slider cover 60 when the first slider 20 and the second slider 30 are urged away from each other. The lateral sides 47*a*, 47*b* of the head portions 49*a*, 49*b* are arcuate shaped as viewed from the outer side 51*b* of the main body 51. The arcuate shape allows the lateral sides 47*a*, 47*b* to slip out of the openings 61*h*, 61*i*, respectively, and abut the lateral walls 61*e*, 61*f*, respectively, and the lateral walls 61*e*, 61*f* urge the lateral arms 58*a*, 58*b* medially until the lateral arms 58*a*, 58*b* are removed from the lateral sockets 64*a*, 64*b*, respectively. The shape of the head portions 49*a*, 49*b* and the transition between the head portions 49*a*, 49*b* and the neck portions 59*a*, 59*b*, respectively, and the stiffness of the material used for the neck portion 59*a*, 59*b* may be selected based on a force and/or acceleration expected to be incident on the plug slider cover 50 based on the intended application of the slide fastener 10. For example, in some applications, if the expected force is 2 Newtons, then the shape of the head portions 49*a*, 49*b*, the shape of the transition between the head portions 49*a*, 49*b* and the neck portions 59*a*, 59*b*, respectively, and/or stiffness of the material for the neck portion 59*a*, 59*b* is selected to allow the head portions 49*a*, 49*b* to slip from the openings 61*h*, 61*i* in response to 2 N of force being applied to the first slider 20 relative to the second slider 30. The force expected to move the sliders 20, 30 may depend on various factors, such as the contact surface area between the sliders and the interlocking stringers and/or interlocking teeth provides, any coatings on the interlocking stringers that increase the friction between the sliders and the stringers, and the manner in which the teeth engage and disengage.

In other implementations, the slide fastener may not include pull tabs or the pull tabs may be integrally formed with the sliders.

In addition, slider covers may be used with sliders or other slide fastener components having other configurations than those described above. For example, one of the slider covers described above may be coupled to fixed components of the slide fastener according to other implementations. For example, the plug slider cover may be coupled to a slider, and the socket slider cover may be coupled to a fixed component (e.g., an end component) on the slide fastener, or vice versa.

In the following description, specific details are set forth describing some implementations consistent with the present disclosure. Numerous specific details are set forth to provide a thorough understanding of the implementations. It will be apparent, however, to one skilled in the art that some implementations may be practiced without some or all of these specific details. The specific implementations disclosed herein are meant to be illustrative but not limiting. One skilled in the art may realize other elements that, although not specifically described here, are within the scope and the spirit of this disclosure. In addition, to avoid unnecessary repetition, one or more features shown and described in association with one implementations may be incorporated into other implementations unless specifically described otherwise or if the one or more features would make an implementation non-functional.

In some instances well known methods, procedures, and components have not been described in detail so as not to unnecessarily obscure aspects of the implementations.

The invention claimed is:

1. A slide fastener comprising:

a first slider and a second slider that are slidably coupled to a pair of interlocking stringers, each slider having an interior wing, an exterior wing, a connecting portion extending between at least a portion of facing and spaced apart surfaces of the interior wing and the exterior wing, and a crown that extends from an outer surface of the exterior wing, wherein each of the interior wing and the exterior wing comprises a front face;

a plug slider cover comprising a main body having an inner side and an outer side, an engagement face extending between the inner side and the outer side, one or more plugs that extend from the engagement face of the plug slider cover, and one or more protrusions that extend from the inner side of the main body toward a plane that includes surfaces of the interlocking stringers that face the protrusions, wherein the inner side of the plug slider cover abuts the outer surface of the exterior wing of the first slider; and a socket slider cover comprising a main body having an inner side and an outer side, an engagement face extending between the inner side and the outer side of the main body of the socket slider cover, the engagement face of the main body of the socket slider cover defining at least one socket, and one or more protrusions that extend from the inner side of the main body of the socket slider cover toward the plane that includes surfaces of the interlocking stringers that face the protrusions, wherein the inner side of the socket slider cover abuts the outer surface of the exterior wing of the second slider, wherein the one or more plugs of the plug slider cover engage the at least one socket of the socket slider cover when the first and second sliders are urged toward each other, and the one or more plugs of the plug slider cover disengage the at least one socket of the socket slider cover when the first and second sliders are urged away from each other.

2. The slide fastener of claim 1, wherein the inner and outer sides of the plug slider cover define an opening that extends through the main body of the plug slider cover, and the crown of the first slider extends through the opening and compresses a portion of the plug slider cover disposed between the crown and the outer surface of the exterior wing of the first slider, and the inner and outer sides of the main body of the socket slider cover defining an opening that extends through the main body of the socket slider cover, and the crown of the second slider extends through the opening that extends through the main body of the socket slider cover and compresses a portion of the socket slider cover disposed between the crown and the outer surface of the exterior wing of the second slider.

3. The slide fastener of claim 1, wherein the distal ends of the one or more protrusions of the plug slider cover and the socket slider cover contact the adjacent surfaces of the interlocking stringers.

4. The slide fastener of claim 1, wherein engagement faces of the plug slider cover and the socket slider cover are sealed together when the one or more plugs are engaged with the at least one socket.

5. The slide fastener of claim 4, wherein:

the engagement face of the plug slider cover comprises a lip that extends from and along at least a portion of the engagement face, the lip being spaced apart from the outer side and the inner side of the main body of the plug slider cover; and the engagement face of the socket slider cover defines a channel that is in communication with the at least one socket, the channel receiving the lip of the engagement face of the plug slider cover when the one or more plugs are engaged with the at least one socket.

6. The slide fastener of claim 4, wherein inner sides of the covers and the portions of the stringers that are between the front faces of the sliders define a cavity when the engagement faces of the plug slider covers and the socket slider cover abut each other, the inner sides of the covers preventing liquid from flowing between the cavity and outer sides of the covers.

7. The slide fastener of claim 1, wherein the one or more plugs comprises a first lateral arm and a second lateral arm, each arm comprising a neck portion and a head portion, wherein the neck portion extends between the head portion and the engagement face, the head portion is spaced apart from the engagement face, the arms are biased in lateral directions, and the neck portion has a width that is less than a width of the head portion.

8. The slide fastener of claim 1, wherein the one or more protrusions of the plug slider cover comprise a first lateral protrusion and a second lateral protrusion, the first and second lateral protrusions each comprise a contact face, and the contact faces of the first and second lateral protrusions abut at least a portion of the front face of the exterior wing of the first slider.

9. The slide fastener of claim 8 wherein the contact face is arcuate shaped.

10. The slide fastener of claim 8, wherein the contact face is planar.

11. The slide fastener of claim 8, wherein a contour of the contact face corresponds to a contour of the respective portion of the front face that the contact face abuts.

12. The slide fastener of claim 8, wherein each slider comprises a first lateral exterior retaining flange that extends from the facing surface of the exterior wing adjacent a first lateral side of the exterior wing, a second lateral exterior retaining flange that extends from the facing surface of the exterior wing adjacent a second lateral side of the exterior wing, a first lateral interior retaining flange that extends from the facing surface of the interior wing adjacent a first lateral side of the interior wing, and a second lateral interior retaining flange that extends from the facing surface of the interior wing adjacent a second lateral side of the interior wing, wherein each retaining flange has distal end, the distal ends of the first lateral exterior retaining flange and the first lateral interior retaining flange are aligned between the facing surfaces and are spaced apart from each other, the distal ends of the second lateral exterior retaining flange and the second lateral interior retaining flange are aligned between the facing surfaces and are spaced apart from each other, and the distal ends of the first and second lateral exterior retaining flanges and distal ends of the first and second lateral protrusions are coplanar.

13. The slide fastener of claim 8, wherein the contact faces of the first and second lateral protrusions are biased medially toward the portions of the front faces of the exterior wing of the first slider that the first and second lateral protrusions abut.

14. The slide fastener of claim 13, wherein at least a portion of each contact face lies within a plane that extends at an angle that is greater than 0° and less than 90° relative to a plane that is orthogonal to the inner side of the main body and extends through the respective protrusion.

15. The slide fastener of claim 1, wherein the main body of the plug slider cover and/or the socket slider cover comprises a rear portion that is opposite and spaced apart from the engagement face of the respective cover, and the rear portion is compressed between the outer surface of the exterior wing of the respective slider and the crown of the respective.

16. The slide fastener of claim 15, wherein the rear portion of the main body of the respective cover is compressed between the outer surface of the exterior wing of the respective slider and the crown of the respective slider after a distal end of the crown of the respective slider is pushed toward the outer surface of the exterior wing of the respective slider.

17. The slide fastener of claim 16, wherein the opening defined by the inner and outer sides of the main body of the respective cover is further defined by the rear portion of the respective cover.

18. The slide fastener of claim 1, wherein the plug slider cover and the socket slider cover comprise a polymer material.

19. The slide fastener of claim 1, wherein the engagement face of the plug slider cover is arcuate shaped.

20. The slide fastener of claim 1, wherein the engagement face of the plug slider cover has one or more planar shaped portions.

21. A slide fastener comprising:

a first slider and a second slider for slidably coupling on a pair of interlocking stringers, each slider having an interior wing, an exterior wing, a connecting portion extending between at least a portion of facing and spaced apart surfaces of the interior wing and the exterior wing, and a crown that extends from an outer surface of the exterior wing, wherein each of the interior wing and the exterior wing comprises a front face;

a plug slider cover comprising a main body having an inner side and an outer side defining an opening that extends through the main body of the plug slider cover, an engagement face extending between the inner side and the outer side, one or more plugs that extend from the engagement face of the plug slider cover, and the crown of the first slider extends through the opening and compresses a portion of the plug slider cover disposed between the crown and the outer surface of the exterior wing of the first slider; and a socket slider cover comprising a main body having an inner and an outer side defining an opening, an engagement face extending between the inner side and the outer side of the main body of the socket slider cover, the engagement face of the main body of the socket slider cover defining at least one socket, and the crown of the second slider extends through the opening that extends through the main body of the socket slider cover and compresses a portion of the socket slider cover disposed between the crown and the outer surface of the exterior wing of the second slider, wherein:

the one or more plugs of the plug slider cover engage the at least one socket of the socket slider cover when the first and second slider are urged toward each other, and the one or more plugs of the plug slider cover disengage the at least one socket of the socket slider cover when the first and second slider are urged away from each other.

* * * * *